US005855468A

United States Patent [19]

Cagle et al.

[11] Patent Number: 5,855,468

[45] Date of Patent: Jan. 5, 1999

[54] METHOD AND APPARATUS FOR SETTING FOUNDRY CORE ASSEMBLIES

[75] Inventors: Billy J. Cagle, Indianapolis; Patrick M. Kelley, Fort Wayne; William H. Shapiro, Indianapolis, all of Ind.

[73] Assignee: Navistar International Transportation Corp., Chicago, Ill.

[21] Appl. No.: 656,400

[22] Filed: May 31, 1996

Related U.S. Application Data

[63] Continuation-in-part of Ser. No. 577,025, Dec. 22, 1995, abandoned.

[51] Int. Cl.[6] ..... B28B 7/28

[52] U.S. Cl. ..... 414/761; 414/763; 414/764; 249/182; 249/184; 164/224; 164/409

[58] Field of Search ..... 414/728, 754, 414/759, 761, 763, 764, 766, 771, 773; 249/177, 182, 184; 164/224, 409

[56] References Cited

U.S. PATENT DOCUMENTS

| | | | |
|---|---|---|---|
| 988,922 | 4/1911 | Barker | 164/224 |
| 1,316,261 | 9/1919 | Ziebarth et al. | 164/402 |
| 1,514,333 | 11/1924 | Ooms | 414/771 |
| 1,968,703 | 7/1934 | Peyinghaus | 164/224 |
| 2,424,712 | 7/1947 | Scherer et al. | 164/402 |
| 3,348,606 | 10/1967 | Ptak et al. | 164/219 |
| 3,650,411 | 3/1972 | Reis et al. | 414/759 |
| 3,831,645 | 8/1974 | Golding et al. | 414/771 |
| 3,862,749 | 1/1975 | Fieser et al. | 414/771 |
| 4,023,685 | 5/1977 | Bishop et al. | 414/759 |
| 4,056,198 | 11/1977 | Boserup | 414/773 |
| 4,305,692 | 12/1981 | Brauer | 414/763 |
| 4,715,775 | 12/1987 | Amino | 414/758 |
| 4,842,473 | 6/1989 | Zbomik | 414/758 |
| 5,046,916 | 9/1991 | Sörensen | 414/758 |
| 5,073,912 | 12/1991 | Kobayashi et al. | 414/754 |
| 5,085,557 | 2/1992 | Koltookian | 414/766 |

FOREIGN PATENT DOCUMENTS

| | | | |
|---|---|---|---|
| 1303647 | 4/1973 | Germany | 414/771 |

*Primary Examiner*—David A. Bucci
*Assistant Examiner*—Douglas Hess
*Attorney, Agent, or Firm*—Dennis K. Sullivan

[57] ABSTRACT

The present invention permits reliable lifting and inverting of one or more casting core elements and positioning the one or more casting core elements in a mold flask. The invention generally includes an outer frame and an inner frame assembly, which are coupled such that they may move vertically relative to each other. The invention further includes apparatus which engage the casting core and invert the casting core, and further align the casting core to a mold to which the core is transferred. The present invention also allows for simultaneous engaging, inverting and aligning of a plurality of core elements. The present invention allows cores to be inventoried and located for automatic handling in a position that permits visual inspection and reliable handling and placement at high production rates therefor.

30 Claims, 5 Drawing Sheets

METHOD AND APPARATUS FOR SETTING FOUNDRY CORE ASSEMBLIES

The present invention is a continuation-in-part of U.S. patent application Ser. No. 08/577,025 to Cagle now abandonded, filed Dec. 22, 1995.

The present invention relates to methods and apparatus for handling casting core assemblies and particularly to methods and apparatus for transferring the assemblies in production. More particularly, the invention relates to methods and apparatus for picking and inverting one or more core assemblies and placing the core assemblies in a mold.

BACKGROUND OF THE INVENTION

Engine blocks and cylinder heads for internal combustion engines are most generally manufactured by casting them from metal alloys. The castings of the engine blocks and cylinder heads must provide for cavities or passageways for coolant, oil, air intake and exhaust, and valve seats. To provide effective cooling of the block and cylinder head, the passageways for the coolant must be interlaced with the oil passages, air intake and exhaust, and the valve seats. These cavities are formed by core elements within the mold that can be removed when the casting metal solidifies.

Core elements can be formed as a single unit or as an assembly of several separate core elements. The core element, or separate core elements, are formed by filling a core box with core sand and a chemical-curing resin. The core box is essentially a mold that forces the sand and resin into the desired shape. After the core has been formed, the core is injected with gas catalyst. After the core element has been cured, it is coated with a refractory wash and sent through an oven for curing. Upon curing of the refractory wash, the core element is ready for use in casting the engine block or cylinder head.

The heart of a quality cylinder head is the casting core assembly. Most of the cost factors and quality issues are dictated by the performance of the casting core. Thus, it is essential that the casting core be handled, stored, and monitored in a fashion that ensures the highest quality standard. Typically, this entails retaining the casting core in the "engine position", that is, with the combustion chamber face oriented downwardly.

While the "engine position" is preferred for handling, storing, and inspecting the casting core, the casting design and process variables sometimes dictate that the cylinder head be cast with the combustion chamber face in the cope, that is, inverted from the "engine position". In the past, when the core element was ready to be inverted for placement in the drag, a foundry worker manually lifted and inverted it so as to orient the combustion chamber face in the cope. For smaller core elements, this has not posed a great difficulty. However, as core elements get heavier, as they do with larger engines, manually inverting a casting core can quickly tax human capabilities and lead to handling errors that result in bad parts. Accordingly, a mechanism and method for reliably lifting, inverting and placing heavy casting cores will make a significant contribution to the manufacture of internal combustion engines and their production In addition, a machine capable of repetitively and accurately lifting, inverting and placing a plurality of casting cores so as to avoid damage to the casting cores while keeping pace with production schedules is particularly needed by engine and cylinder head manufacturers.

SUMMARY OF THE INVENTION

The present invention includes a method and apparatus for reliably lifting and inverting one or more heavy casting core elements and for positioning the one or more cores in a mold flask. Such apparatus can comprise an outer frame, at least one means coupled to the outer frame for engaging a casting core, and means for rotating the engaging means to invert the casting core. In preferred embodiments, a plurality of means are coupled to the outer frame for engaging a plurality of casting cores, and the plurality of coupling means are rotated simultaneously by the rotating means for simultaneous inversion of the casting core. The invention thus allows one or more heavy cores to be inventoried and located for automatic handling in a position that permits visual inspection and reliable handling and placement at high production rates therefor.

The engaging means includes preferably a cradle and a plurality of clamps coupled thereto for engaging the casting core. The clamps are movable about pivot pins between an engaged position and a disengaged position. A clamp actuator is provided to move the clamps about the pivot pins for engagement of a casting core.

The apparatus further preferably comprises an interior frame assembly coupled to the outer frame for vertical relative movement therebetween to provide a cushioned impact upon placement of the one or more cores. The one or more cradles are coupled to the interior frame for rotation about a rotation axis. In preferred embodiments, axes of rotation are offset, and disposed above, the split line of the mold cavity when the one or more casting cores have been inverted for positioning in the mold flask. A rotation actuator, preferably a rack and pinion, is coupled to the interior frame. A chain drive couples the rack and pinion to the one or more cradles to rotate the cradles in response to movement of a single rack and pinion drive and a single driving cylinder.

The apparatus further comprises means for determining the relative positions of the outer frame, the engaging means and one or more casting cores. In preferred embodiments, the determining means includes a plurality of position detectors and control means for receiving and processing signals output by the plurality of position detectors. Computer means is provided for receiving and processing position signals from the position detectors and providing signals for controlling the movement of the outer frame, the clamps, and the cradle, to allow automatic handling and placement of the casting core.

The method of the invention comprises the steps of providing one or more cradles, each cradle having a plurality of movable casting core-engaging clamps, positioning the one or more cradles at an engaging position, moving the casting core-engaging clamps to engage one or more casting cores, and lifting and rotating the one or more cradles and casting cores for placement on one or more molds.

The rotating step further includes the step of providing a rotation actuator and means coupled to the rotation actuator for rotating one or more cradles. The providing step can further include the step of providing a setting machine for moving the cradle vertically and horizontally. In the method of the invention, the positioning step includes the step of moving the outer frame into position against the a lower tub holding the casting core. The positioning step further includes allowing the interior frame to move vertically relative to the outer frame, after the outer frame is positioned against the tub, to position the cradle in an engaging position.

Additional features and advantages of the invention will become apparent to those skilled in the art upon consideration of the following detailed description of a preferred embodiment exemplifying the best mode of carrying out the invention as presently perceived.

DETAILED DESCRIPTION OF THE DRAWINGS

Figure 1:
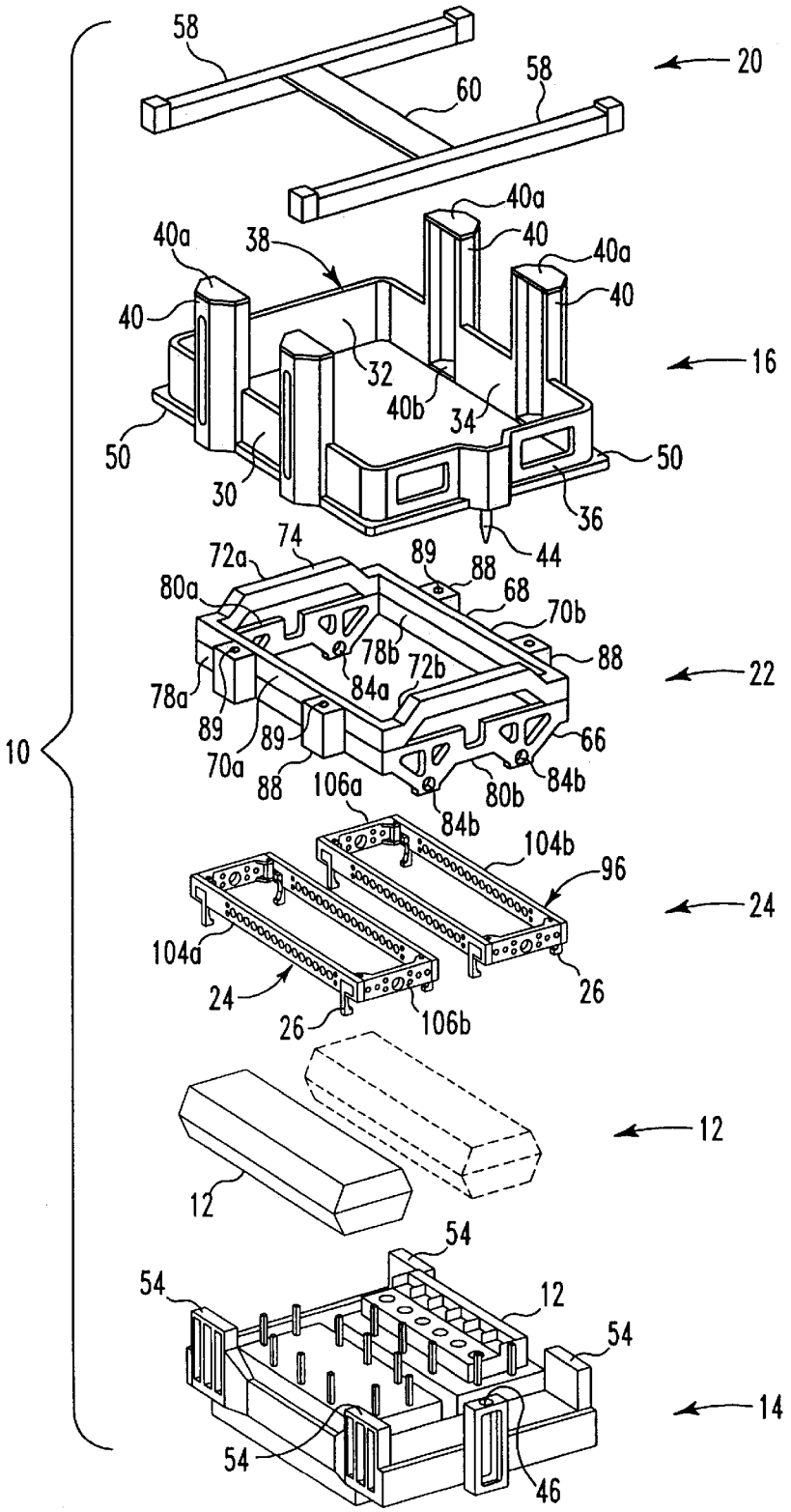
FIG. 1 is an exploded view of the apparatus for transferring and positioning a casting core in the drag of a mold flask.
Figure 2:
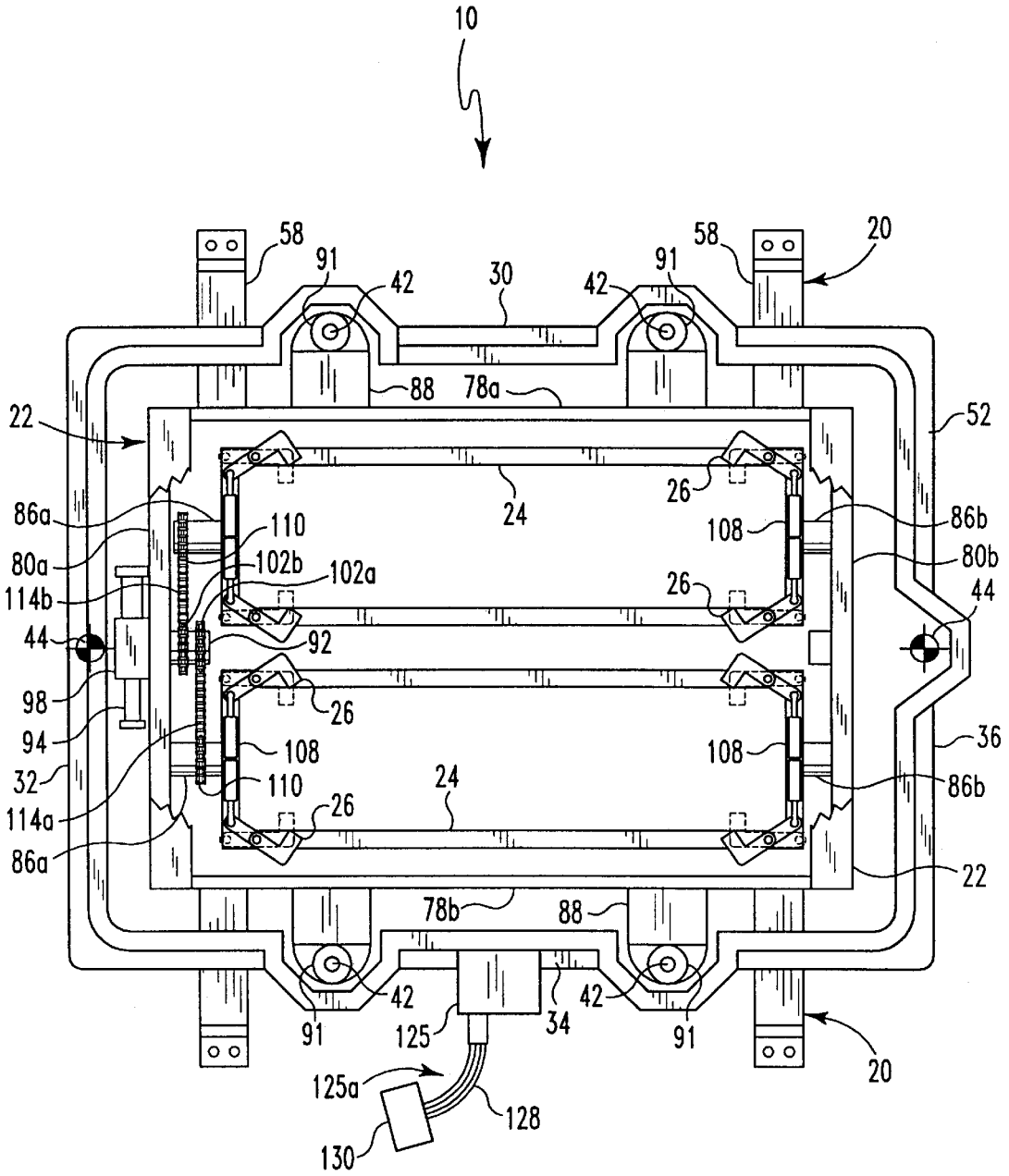
FIG. 2 is a bottom plan view of the outer frame, interior frame assembly, and cradles illustrated in FIG. 1.
Figure 3:
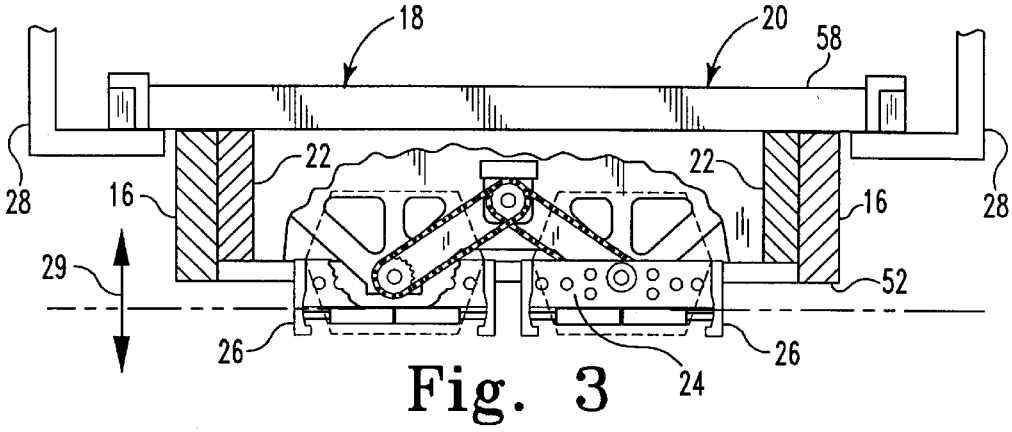
FIG. 3 is an end view, partially broken away, of a cradle rotating mechanism positioned above a pair of casting cores.
Figure 4:
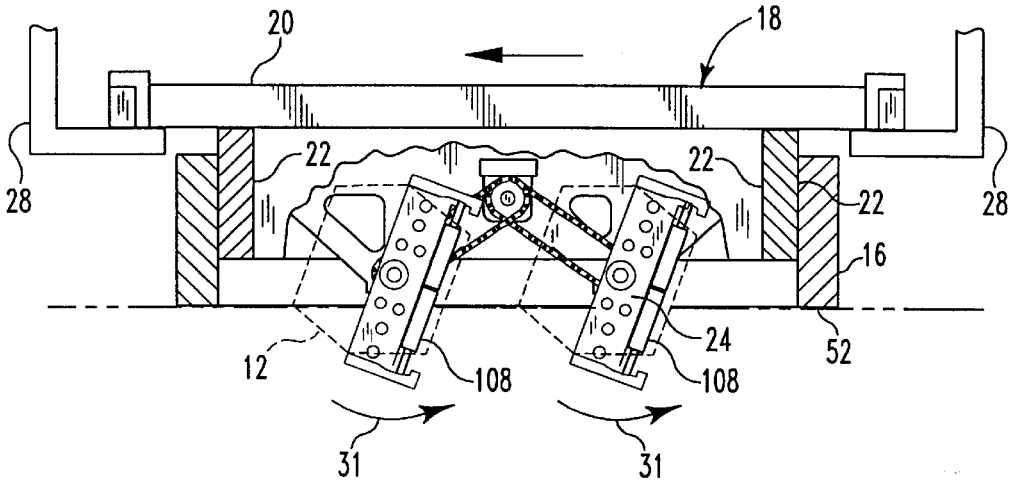
FIG. 4 illustrates the cradle rotating mechanism of FIG. 3 engaged with and rotating the casting cores.
Figure 5:
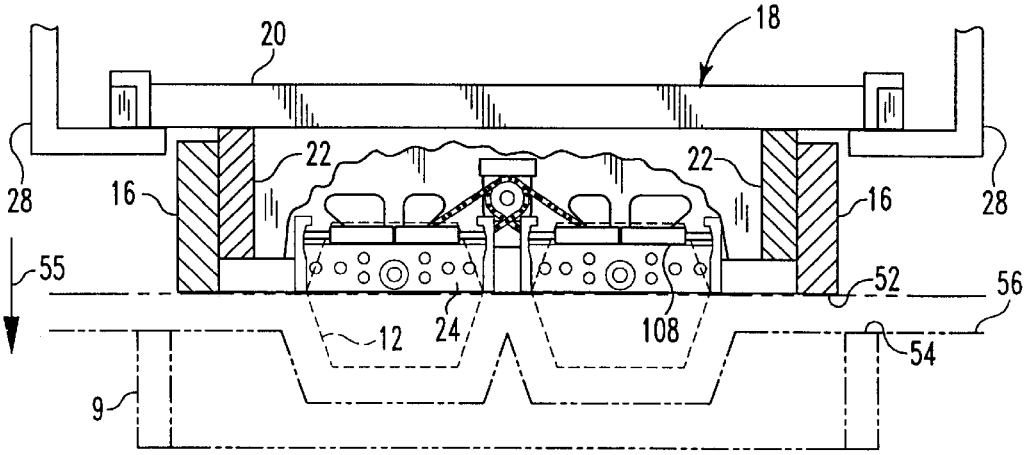
FIG. 5 illustrates the cradle rotating mechanism of FIG. 3 with the casting cores inverted and ready to be inserted into the drag of a mold flask.

Apparatus 10 for lifting a casting core 12 out of a lower holding tub 14 and inverting the casting core 12 while moving the casting core 12 to the drag of a mold flask 9 is illustrated in FIGS. 1–2. The apparatus 10 includes an outer frame 16, an interior frame assembly 18, which includes an H-member 20 coupled to an intermediate frame 22, and a pair of cradles 24 disposed within the intermediate frame 22. The H-member 20 and the intermediate frame 22 are bolted together or otherwise permanently attached to each other to form the interior frame assembly 18. When assembled, the interior frame assembly 18 is disposed within the outer frame 16, as shown in FIG. 2. The interior frame assembly 18 is vertically movable with respect to the outer frame 16, and the cradles 24 are rotatably movable within the intermediate frame 22 as shown in FIGS. 3–5. A plurality of clamps 26 are pivotally coupled to the cradles 24 for engaging the casting cores 12. A conventional setting machine 28 (FIGS. 3–5) is coupled to the interior frame assembly 18 to move the apparatus 10 up or down in direction of arrow 29 (FIG. 3) relative to the lower tub 14. The setting machine 28 is loosely coupled to the interior frame assembly 18 to permit the interior frame assembly 18 to essentially rest on the setting machine 28. Thus, the setting machine 28 can only exert an upward force against the interior frame assembly 18 and cannot exert a downward force when lowering the interior frame assembly 10.

The outer frame 16 includes a plurality of sidewalls 30, 32, 34, 36 defining a generally rectangular body 38 and a plurality of vertical towers 40 extending upwardly and outwardly from opposing sidewalls 30, 34. The towers 40 are disposed in opposing pairs and include a top plate 40*a* and a bottom plate 40*b*. Each tower 40 is sized and configured to house and retain an alignment rod 42 (FIG. 2) that extends between the top and bottom plates 40*a*, 40*b*. A pair of alignment pins 44 extend downwardly from opposing sidewalls 32, 36 to engage receiving apertures 46 formed in the lower tub 14 for aligning the apparatus 10 with the lower tub 14 as the setting machine 28 lowers the outer frame 16 onto the lower tub 14.

A flange 50 extends outwardly from the bottom surface of each sidewall 30, 32, 34, 36 to define a mating surface 52 (FIGS. 2–5). The lower tub 14 includes a complementary mating surface 54 which is located relative to the casting cores 12 disposed in the lower tub 14 to simulate the parting line 56 of the mold flask 9. By simulating the mold parting line 56 on the lower tub 14, the same amount of vertical movement of the interior frame assembly 18 relative to the outer frame 16 is used to engage and lift the casting cores 12 out of the lower tub 14 and to lower the casting cores 12 into the mold flask 9. Thus, the casting cores 12 can be set in the mold flask 9 precisely and without damage.

The H-member 20 includes a pair of parallel stop members 58 and a cross bar 60 extending orthogonally between the stop members 58. The stop members 58 are disposed outside of the towers 40 so that all of the towers 40 are positioned between the stop members 58. In operation, the outer frame 16 is vertically movable relative to the interior frame assembly 18 between an upper position and a lower position. In the upper position, the stop members 58 rest on the top surface of the sidewalls 30, 32, 34, 36 to define an upper limit to the vertical movement of the outer frame 16 relative to the interior frame assembly.

The intermediate frame 22 includes a cradle support member 66 and a connecting member 68 for attaching the cradle support member 66 to the H-member 20. The connecting member 68 includes a rectangular framework having a pair of parallel side pieces 70*a*, 70*b* and a pair of end pieces 72*a*, 72*b* extending between the ends of the side pieces 70*a*, 70*b*. Each end piece 72*a*, 72*b* includes a raised center portion 74. When the interior frame assembly 18 is assembled, the stop members 58 extend beyond, and rest on, the side pieces 70*a*, 70*b* and the raised center portions 74 lie parallel to, and adjacent, the stop members 58. The H-member 20 can be attached to the connecting member 68 by conventional means.

The cradle support member 66 includes a pair of side pieces 78*a*, 78*b* aligned with, and disposed adjacent and below, side pieces 70*a*, 70*b* and a pair of end pieces 80*a*, 80*b* that are aligned with, and disposed below, end pieces 72*a*, 72*b*. The end pieces 80*a*, 80*b* include journal boxes 84*a*, 84*b* for receiving cradle journals 86*a*, 86*b* (FIG. 2) which provide an axis of rotation for the cradles 24 within the cradle support member 66. A plurality of assembly support blocks 88 are attached to the side pieces 70*a*, 70*b*, 78*a*, 78*b* and are positioned so as to be disposed in the vertical towers 40 when the interior frame assembly 18 is positioned in the outer frame 16. Each support block 88 includes a central bore 89 sized and configured to house and retain a plurality of bushings 91 (FIG. 2). The bushings 91 are configured to receive the alignment rods 42 disposed within the towers 40. The bushing/alignment rod interaction serves to control the relative movement between the interior frame assembly 18 and the outer frame 16 and to limit the impact on the casting cores 12 as they are placed in the mold 9. Thus, in addition to an alignment function, the bushing/rod interaction can also provide a shock dampening effect during movement of the interior frame assembly 18 relative to the outer frame 16.

A pinion gear 92 extends through the end piece 80*a*, as best shown in FIG. 2. A rotation actuator 94, preferably a hydraulic drive cylinder, is attached to the end piece 80*a* and drives a rack 98 in a back and forth motion adjacent the end piece 80*a*. One end of the pinion gear 92 is in meshing contact with the rack 98. The other end of the pinion gear 92 includes a pair of drive sprockets 102*a*, 102*b*.

Each cradle 24 includes a rectangular frame 96 with side members 104*a*, 104*b* and end members 106*a*, 106*b*. Referring to FIG. 2, a plurality of clamps 26 are pivotally coupled to the side members 104*a*, 104*b* for engaging the casting core 12 and are pivotable between an engaged position (shown in dotted lines) and a disengaged position (shown in solid lines). A plurality of clamp actuators 108, preferably small hydraulic cylinders, are attached to the end members 106*a*, 106*b* and are coupled to the clamps 26 to pivot the clamps 26 between the engaged position and the disengaged position. The clamp actuators 108 are positioned on top of cradles 24 when the cradles 24 are oriented to engage the casting cores 12.

The journals 86*a*, 86*b* about which the cradles rotate are rigidly attached to, and extend outwardly from, each end member 106*a*, 106*b* (FIG. 2) for rotatably engaging the journal boxes 84*a*, 84*b* formed in the cradle support member 66. Advantageously, the journals 86*a*, 86*b* are offset from the mold parting line 56 so that when the cradles 24 are in position to engage the casting cores 12, the clamp actuators 108 are clear of the mold flask 9. At end members 106*a*, the journals 86*a* include a sprocket 110 rigidly attached thereto. The sprockets 110 are coupled to drive sprockets 102*a*, 102*b* by chain 114*a*, 114*b*, or other suitable drive means. Thus, actuation of the rotation actuator 94 drives the rack 98 back and forth which rotates the pinion gear 92 which drives the chains 114*a*, 114*b* which rotate the journals 86*a*, 86*b*, thereby translating the linear movement of the actuator 94 into rotation of the cradles 24.

Figure 6:
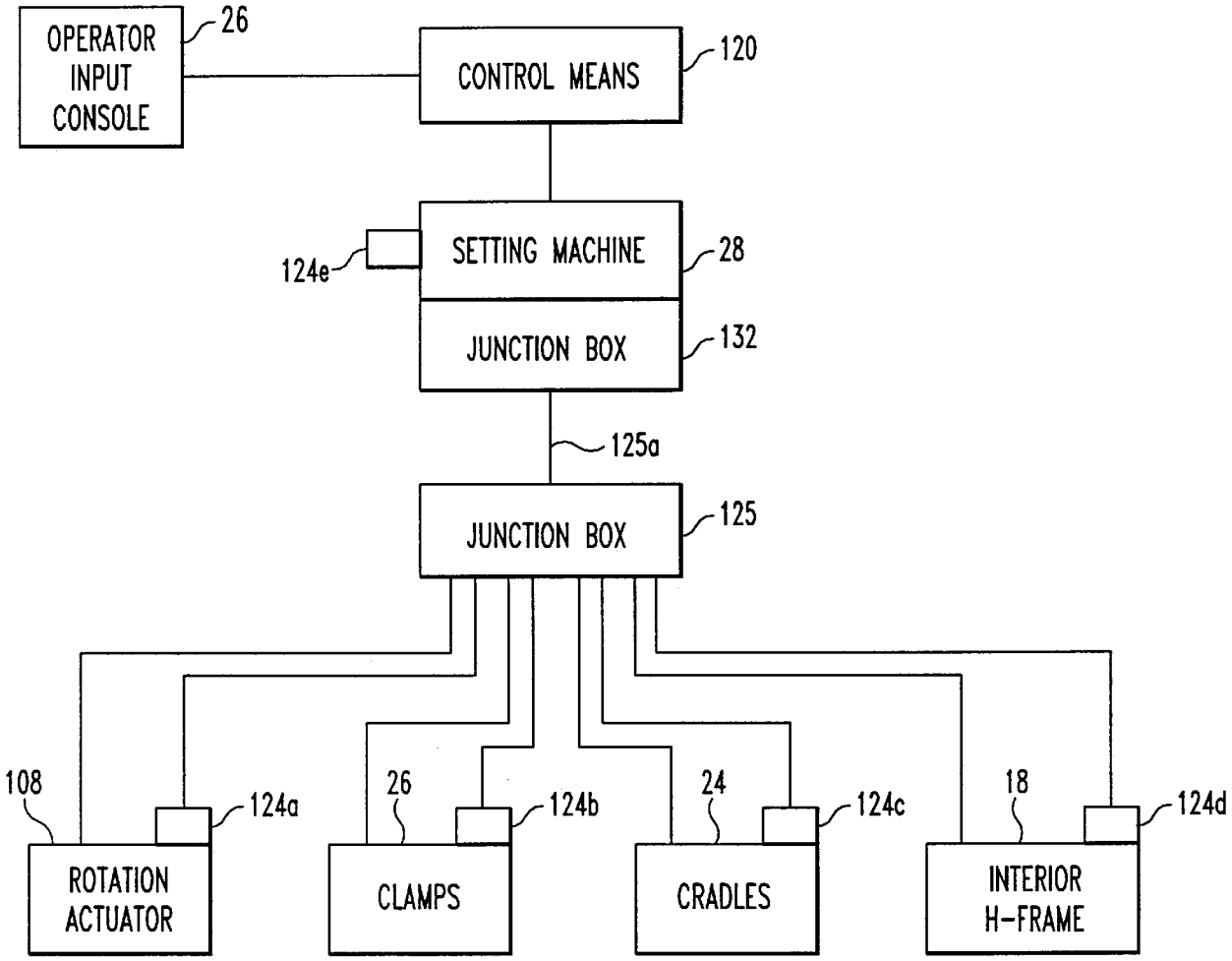
FIG. 6 is a schematic of a control system including position switches and control means for controlling the movement of the apparatus of FIG. 1.

The apparatus 10 also includes means for determining the relative positions of the outer frame 16, the interior frame assembly 18 and the cradles 24, as well as the engagement status of the clamps 26. The determining means includes a plurality of switches coupled to a control means 120 (FIG. 6), which is preferably a digital computer executing a computer program, via electrical cabling which runs from conventional switches 124*a*–124*d* located on the outer frame 16, interior frame assembly 18, and cradles 24 through a junction box 125 (FIG. 2). Switches 124*a*–124*e* are conventional position indicators, and can include linear transducers, limit switches, or the like.

Figure 7A:
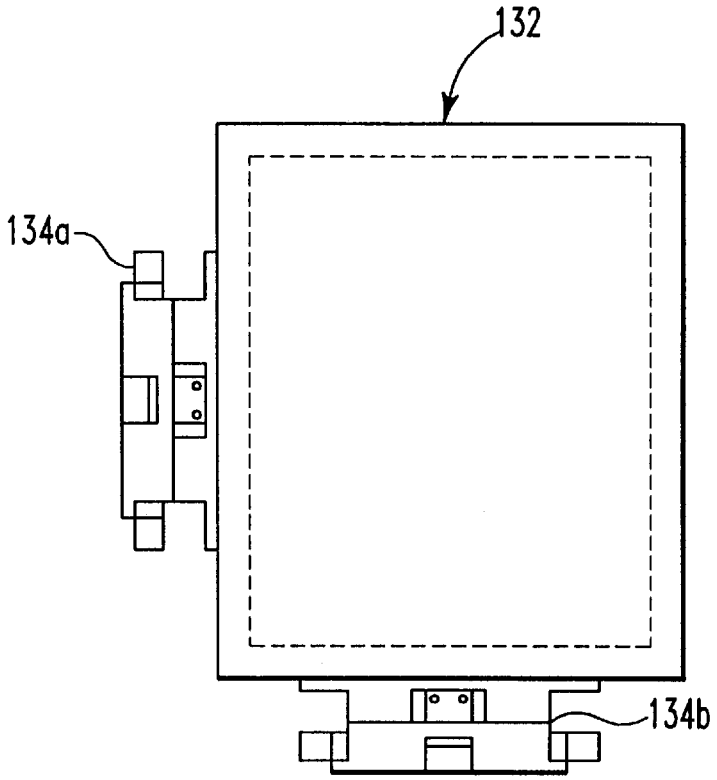
FIG. 7*a* is a plan view of a junction box.
Figure 7B:
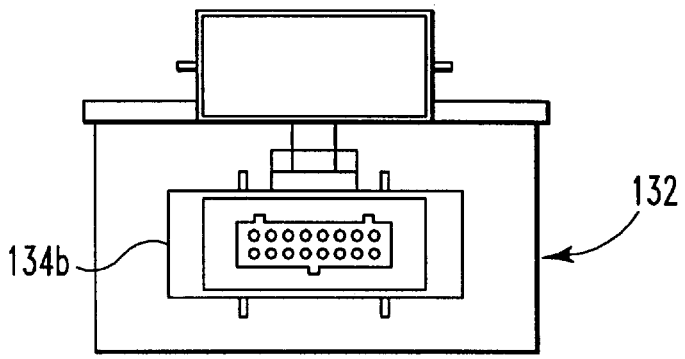
FIG. 7*b* is a side view of the junction box of FIG. 7*a* showing a representative female socket.

An interconnecting plug 125*a* couples the apparatus 10 of the invention to the setting machine 28. The interconnecting plug 125*a* extends from the junction box 125 and includes a conventional conduit 128 with a plurality of conductors connected to a conventional 16-pin male plug 130. A junction box 132 (FIGS. 7*a*, 7*b*) is attached to the setting machine 28 and includes two conventional 16-pin female sockets 134*a*, 134*b*, which are configured to receive 16-pin male plugs.

The wiring of the existing control means 120 includes the wiring of a "dummy" plug that is plugged into junction box 132. The "dummy" plug includes a direct connection between pins 1 and 7 and is plugged into the socket 134*a* on the setting machine 28 when the setting machine 28 is being used with conventional equipment. When the control means 120 sees the connection between pins 1 and 7, it knows that the setting machine 28 is being used to operate conventional equipment.

The male plug 130, on the other hand, includes a direct connection between pins 3. and 8 rather than between pins 1 and 7 and is plugged into socket 134*a* when the setting machine 28 is operating the apparatus 10 of the invention. When the control means 120 sees the connection between pins 1 and 8, it recognizes the apparatus 10 of the invention and knows to activate that portion of its computer program that controls the invention. Thus, the apparatus 10 is self-identifying, thereby allowing the control means 120 to distinguish between conventional equipment and the invention.

When the male plug 130 of the invention is plugged into the socket 134*a*, the "dummy" plug is plugged into socket 134*b*. The socket 134*b* is a "dummy" socket used as a storage place for the "dummy" plug when the invention is in use.

Using the output of switch 124*a*, the control means 120 determines the position of the rotation actuator 94. Switch 124*b* tells the control means 120 whether the clamps 26 are in the engaged position or the disengaged position. The control means 120 determines whether the cradles 24 are in the upright position (FIG. 3), the inverted position (FIG. 5) or an intermediate position (FIG. 4) based on the output of switch 124*c*. Switch 124*d* indicates whether the interior frame assembly 18 is in the raised position or the lowered position relative to the outer frame 16. Switch 124*e* tells the control means 120 whether the outer frame 16 is resting on the lower tub 14 or the mold flask 9 or is somewhere in between those positions.

Control means 120 uses the signals from the operator input console 126 and from switches 124*a*–124*e* to control the movement of the outer frame 16 and the casting cores 12. For example, if an operator commands the apparatus 10 to pick up casting cores 12 from the lower tub 14, control means 120 checks the switch 124*e* for an indication that the outer frame 16 is not positioned on the lower tub 14, checks switch 124*b* for an indication that the clamps 26 are in the disengaged position, and checks switch 124*c* to determine if the cradles are in the upright position. If those conditions are met, the control means 120 will know that the apparatus 10 is ready to pick casting cores 12 out of the lower tub 14 and will move the outer frame 16 downwardly to rest on the lower tub 14.

As the setting machine 28 lowers the outer frame 16 down onto the lower tub 14, alignment pins 44 engage alignment apertures 46 on the lower tub 14 to ensure that the cradles 24 and clamps 26 are properly placed relative to the casting cores 12. In operation, the interior frame assembly 18 is essentially suspended from the setting machine 28 and the outer frame 16 is pulled down by gravity relative to the interior frame assembly 18 to the lower position. As the setting machine lowers the interior frame assembly 18, and thus the entire apparatus 10, alignment pins 44 on the outer frame 16 engage alignment apertures on the lower tub 14 to ensure that the cradles 24 and clamps 26 are properly placed relative to the casting cores 12. As the setting machine 28 continues to lower the interior frame assembly 18, the mating surface 52 of the outer frame 16 contacts the mating surface 54 of the lower tub 14 and comes to rest, while the bushings 89 ride along the alignment rods 42 to control the rate of descent of the cradles 24 toward the casting cores 12.

When switch 124*d* tells the control means that the interior frame assembly 18 is fully lowered, the control means actuates the clamp actuators 108 to pivot the clamps 26 to engage the casting cores 12. When switch 124*b* indicates that the clamps 26 have engaged the casting cores 12, the control means actuates the setting machine 28 to raise the interior frame assembly 18 to a predetermined height. As the interior frame assembly 18 moves up, the blocks 88 more along the alignment rods 42 until the blocks 88 contact the top plates 40*a*. Further upward movement of the setting machine 28 lifts the outer frame 16 off of the lower tub 14.

From this point, the control means 120 tells the setting machine 28 to move horizontally toward the mold flask 9. At the same time, the control means 120 actuates the rotation actuator 94 to rotate the cradles 24 and casting cores 12 in direction of arrows 31 (FIG. 4).

Preferably, the rotation actuator 94 is set up to invert the casting cores 12 during the horizontal movement of the setting machine 28, so that when the setting machine 28 is positioned over the mold flask 9, the casting cores 12 are ready to be laid in the flask 9. Of course, the setting machine 28 should be set up to move the casting cores 12 from the lower tub 14 to the mold flask 9 in the time allotted by the production schedule so that as each mold flask 9 is brought into position to receive the casting cores 12, the setting machine 28 has the casting cores 12 ready to be laid in the flask 9.

When the control means 120 receives a signal from switch 124*e* that the outer frame 16 is positioned over the mold flask 9, and switch 124*c* indicates that the casting cores 12 are inverted, the control means 120 orders the setting machine 28 to lower the interior frame assembly 18 onto the mold flask 9 in direction of arrow 33 (FIG. 5). When switch 124*d* indicates that the interior frame assembly 18 has been lowered, the control means actuates the clamp actuators 108 to pivot the clamps 26 out of engagement with the casting cores 12 to the disengaged position. After the casting cores 12 have been released by the clamps 26, the control means 120 orders the setting machine 28 to raise the interior frame assembly 18 to the predetermined height. When the setting machine 28 reaches the predetermined height, the control means orders the setting machine 28 to move horizontally back to the position above the lower tub 14 and simultaneously orders the rotation actuators 94 to rotate the cradles 24 back to the upright position so as to be ready to engage the casting cores 12 when the outer frame 16 is located above the lower tub 14.

It will be appreciated by those of ordinary skill in the art that not all of switches 124*a*–124*e* are required for proper operation of the invention. For example, switch 124*b* is not required if the assumption is made that the clamps will close or open when the control means 120 directs them to do so. The control means 120 can merely set a flag in its memory to indicate that the signal has been sent and assume that the clamps responded appropriately. Similarly, switch 124*b* may not be required if the assumption is made that when the setting machine lifts the interior frame assembly that the outer frame will move down the alignment rods 42 to the fully extended lower position. Likewise, when the setting machine lowers the interior frame assembly all the way down, the control means assumes that the outer frame is pushed up all the way relative to the interior frame assembly by virtue of its contact with the tub 14 or the mold flask 9.

Although the invention has been described in detail with reference to a particular preferred embodiment, variations and modifications exist within the scope and spirit of the invention as described and defined in the following claims.

We claim:

1. An apparatus for inverting a casting core to be positioned in a mold flask, the apparatus comprising:

an outer frame;

carriage means, coupled to the outer frame, for carrying the casting core;

a drive, carried by the outer frame, for rotating the carriage means to invert the casting core;

means for determining relative positions of the outer frame, the carriage means, and the casting core, including a plurality of position detectors;

control means for receiving and processing position signals from the plurality of position detectors, and an operator console for inputting command signals for the apparatus, said control means receiving and processing said command signals and position signals, and providing a control signal for controlling the engagement and movement of the casting core.

2. The apparatus of claim 1 wherein the carriage means includes at least one cradle and a plurality of clamps coupled thereto for engaging the casting core.

3. The apparatus of claim 2 wherein the clamps are movable between a disengaged position and an engaging position.

4. The apparatus of claim 3 wherein the carriage means further includes at least one clamp actuator, and each clamp pivots about a pivot pin between the disengaged position and the engaging position in response to movement of the at least one clamp actuator.

5. The apparatus of claim 1 further comprising an interior frame coupled to the outer frame for vertical movement relative thereto and carrying the carriage means, the carriage means comprising at least one cradle rotatably coupled to the interior frame.

6. The apparatus of claim 5 wherein the interior frame comprises an H-member engaging the outer frame for relative movement with respect thereto in the vertical direction and carrying the carriage means, the carriage means comprising an intermediate frame carried by said H-member and rotatably carrying said cradle.

7. The apparatus of claim 1 wherein the carriage means includes a cradle which rotates about a rotation axis, the rotation axis being offset from, and disposed above, a parting surface of the mold flask when the casting core is positioned in the mold flask.

8. The apparatus of claim 1 further comprising means for moving the outer frame vertically and horizontally to position the carriage means relative to the casting core.

9. The apparatus of claim 8 wherein rotational movement of the cradle is accomplished during horizontal movement of the moving means.

10. The apparatus of claim 1 further comprising an interior frame coupled to the outer frame for vertical movement relative thereto and carrying the carriage means, the carriage means comprising a cradle rotatably coupled to the interior frame; the apparatus further comprising a plurality of position detectors including means for detecting the position and orientation of the cradle.

11. The apparatus of claim 1 further comprising an interior frame movably coupled to the outer frame, and the determining means includes a first position detector for determining the position of the interior frame and a second position detector for determining the position of the outer frame.

12. The apparatus of claim 1 wherein the control means controls movement of the outer frame and casting core engagement means, and the apparatus further comprises means, coupled to the outer frame, for electrically connecting the determining means to the control means.

13. The apparatus of claim 12 wherein the means for electrically connecting includes means for self-identification.

14. An apparatus for inverting a casting core to be positioned in a mold flask, the apparatus comprising:

an outer frame;

carriage means, coupled to the outer frame, for carrying the casting core;

an interior frame coupled to the outer frame for vertical movement relative thereto and carrying the carriage means, the carriage means comprising at least one cradle rotatably coupled to the interior frame; and drive means for rotating the cradle to invert the casting core, said drive means comprising a rotation actuator including a rack and pinion coupled to the carriage means by a first gear coupled to the pinion and a second gear coupled to the cradle and a belt drive engaging the first and second gears together.

15. An apparatus for handling at least two casting cores to be positioned in a mold flask, the apparatus comprising:

an outer frame;

an interior frame movably coupled to the outer frame for vertical movement relative thereto;

at least two cradles rotatably coupled to the interior frame, each cradle including a plurality of clamps movably coupled to the cradle for engaging a casting core; and a drive for rotating the at least two cradles to invert the casting cores.

16. The apparatus of claim 15 wherein the plurality of clamps are pivotally coupled to each cradle for movement between a disengaged position and an engaged position.

17. The apparatus of claim 15 wherein the drive for rotating the at least two cradles rotates said cradles relative to the interior frame.

18. The apparatus of claim 17 wherein the drive for rotating the at least two cradles includes a rotation actuator and means for converting movement of the rotation actuator into rotation of the at least two cradles.

19. The apparatus of claim 18 wherein the rotation actuator is a pressure-driven piston and cylinder and said means for converting movement of said rotation actuator into rotation of the at least two cradles includes a piston-driven rack and a rotatably mounted rack-driven pinion gear, said pressure-driven piston and cylinder, piston-driven rack and rotatably mounted rack-driven pinion gear being carried by said interior frame, and a belt drive extending between said pinion gear and a driving gear on each cradle.

20. The apparatus of claim 15 wherein each cradle rotates about a rotation axis that is offset from, and disposed above a parting surface of the mold flask when the casting core is positioned in the mold flask.

21. An apparatus for inverting a casting core for insertion into a mold flask, the apparatus comprising:

means for positioning the casting core for automatic handling and for inspection of its integrity;

an outer frame movable to descend onto the positioning means;

means for aligning the outer frame with the positioning means while the outer frame descends onto the positioning means;

an interior frame assembly coupled to the outer frame for movement relative thereto;

a cradle rotatably coupled to the interior frame assembly;

a plurality of clamps pivotally coupled to the cradle for engaging the casting core;

means for actuating the plurality of clamps to engage the casting core, the interior frame assembly being lowered into a casting core engaging position upon alignment of the outer frame and positioning means and and being raised to lift the casting core out of the positioning means after the clamps have engaged the casting core; and a setting machine for lifting and moving the outer frame between the positioning means and the mold flask.

22. The apparatus of claim 21 further including control means, coupled to the setting machine, for controlling the actuating means and the lifting and moving of the setting machine.

23. The apparatus of claim 22 further including a plurality of position switches and means for electrically connecting the control means to the plurality of position switches, the connecting means including means for self-identification.

24. An apparatus for transferring a casting core to a mold, comprising:

means for positioning the casting core for transfer, and transfer means adapted for positioning with the casting core positioning means and for engaging a casting core when positioned with respect to the casting core positioning means, said casting core transfer means being adapted for vertical movement with respect to said positioning means and for rotation of an engaged casting core, said casting core transfer means being operable to engage a casting core when in position on the casting core positioning means and further adapted to prevent rotation of an engaged casting core until the transfer means is disengaged from the casting core positioning mean, said casting core transfer means including means for inverting an engaged casting core with respect to the transfer means after disengagement of the transfer means from the positioning means in transferring a casting core from the positioning means to a mold.

25. The apparatus of claim 24 wherein the transfer means comprises an outer frame for engagement with the positioning means and an interior frame for engagement of a casting core, said outer frame and interior frame being engaged to provide relative vertical movement of the interior frame with respect to the outer frame.

26. The apparatus of claim 25 wherein shock dampening means are provided for the relative movement between the interior frame and outer frame.

27. The apparatus of claim 25 wherein the transfer means comprises one or more sensors to prevent rotation of an engaged core absent an acceptable disengagement of the transfer means from the positioning means.

28. Apparatus for transferring and positioning a mold core in a mold, comprising:

a positioner including carriage engagement means for engaging a core carriage, said engagement means retraining the core carriage from relative horizontal movement and permitting relative vertical movement of the core carriage with respect to the positioner, and further including at least one position alignment means for the positioning of the core with respect to at least one core to be transferred and positioned;

core carriage means including positioner engagement means for engaging said carriage means, and core engagement means for engaging at least one core simultaneously while maintaining its position, and further including means permitting lifting and unrestrained movement of the core carriage means, said core carriage means, when carried by said lifting means, being vertically positioned in said positioner and being lowered, upon engagement of the position alignment means of the positioner, for engagement of a core to be transferred.

29. The apparatus of claim 28 wherein said at least one position alignment means is adapted to engage a mold core positioning means for a mold core to be transferred and to engage a mold for the mold core.

30. The apparatus for lifting and inverting at least one core, comprising:

a core carriage means including a cradle encompassing a core at least from its sides, a plurality of core engaging clamps carried by the cradle on both sides of a core and operable simultaneously to engage both sides of a core, said cradle comprising a pair of rotation surfaces positioned on a central axis of the core, said core carriage means further comprising a pair of complementary rotation surfaces engaging and carrying the pair of cradle rotation surfaces, and drive means for engaging and rotating said cradle with respect to said core carriage means whereby said core can be inverted about the central axis, and positioning means carried by said core carriage means and engaged with said core carriage means to provide freedom of relative vertical motion, said positioning means having an upper position and a lower position, said upper position in said positioning means occurring when said core carriage means is being lifted for movement and said lower position in said positioning means occurring when said positioning means is engaged for positioning the core carriage means.

* * * * *